United States Patent [19]

Walstra

[11] Patent Number: 4,496,496

[45] Date of Patent: Jan. 29, 1985

[54] FUEL SUPPLY SYSTEM WITH ELECTRIC CHOKE AND CONTROL THEREFOR

[75] Inventor: Hidde Walstra, Almelo, Netherlands

[73] Assignee: Texas Instruments Incorporated, Dallas, Tex.

[21] Appl. No.: 437,982

[22] Filed: Nov. 1, 1982

[51] Int. Cl.[3] ..... F02M 1/12

[52] U.S. Cl. ..... 261/39 E; 337/89

[58] Field of Search ..... 261/39 E

[56] References Cited

U.S. PATENT DOCUMENTS

| | | | |
|---|---|---|---|
| 2,481,259 | 9/1949 | Taylor | 261/39 E |
| 3,500,277 | 3/1970 | Nardulli . | |
| 3,752,133 | 8/1973 | Irish et al. | 261/39 E |
| 3,806,854 | 4/1974 | Armstrong . | |
| 3,972,311 | 8/1976 | De Petris | 261/39 E |
| 4,026,464 | 5/1977 | Doherty, Jr. . | |
| 4,032,071 | 6/1977 | Imoto . | |
| 4,038,955 | 8/1977 | Paulmier | 261/39 E |
| 4,083,336 | 4/1978 | Armstrong et al. . | |
| 4,117,976 | 10/1978 | Doherty, Jr. . | |
| 4,131,657 | 12/1978 | Ball, Jr. et al. | 261/39 E |
| 4,142,676 | 3/1979 | Hattori . | |
| 4,201,735 | 5/1980 | Byam | 261/39 E |
| 4,237,077 | 12/1980 | Berg . | |
| 4,331,615 | 5/1982 | Walstra et al. . | |

*Primary Examiner*—Tim Miles

*Attorney, Agent, or Firm*—James P. McAndrews; John A. Haug; Melvin Sharp

[57] ABSTRACT

A fuel supply system for an automotive engine has a heater which is energized, deenergized and then reenergized in sequence to heat a thermostat metal coil spring over a selected temperature range to regulate opening of a carburetor choke during engine warm up. The heater operation causes the choke to start to open quickly to enhance fuel economy, then to open more slowly to enhance engine driveability as engine warm up occurs, and finally to complete opening in a rapid fashion to enhance fuel economy when engine driveability is assured after engine warm up has taken place. Contacts are connected between a power source and the heater and a pair of dished bimetal elements having central apertures therein are arranged in facing relation to each other between the contacts, the bimetal elements being adapted to move to inverted dished configuration as they are heated to respective different temperatures within the noted temperature range. The contacts are engaged with each other through the element apertures when engine operation is initiated, are separated when one of the elements moves to its inverted configuration in response to heating of the element, and are then reengaged as the second element moves to its inverted configuration in response to further heating.

6 Claims, 3 Drawing Figures

FUEL SUPPLY SYSTEM WITH ELECTRIC CHOKE AND CONTROL THEREFOR

BACKGROUND OF THE INVENTION

The field of this invention is that of fuel supply systems for internal combustion engines and the invention relates more particularly to a fuel supply system having an electric choke in which a heater is arranged to heat a thermally responsive coil spring to regulate choke operation and wherein novel and advantageous control means energize and deenergize the heater in particular sequence in a novel and advantageous manner to achieve improved choke operation.

Conventional fuel supply systems for automotive engines include a carburetor having an air-fuel induction passage for providing a mixture of air and fuel to the engine and incorporate an unbalanced-mounted, air-movable choke valve which is mounted for movement across the passage to regulate air-flow into the passage. A thermally responsive thermostat metal coil spring is operatively connected to the choke valve and is movable in response to increase in temperature to bias the choke valve toward a position which restricts air flow into the passage with a force which decreases over a selected force range in response to increase in temperature of the coil spring over a selected temperature range. The coil spring is heated in response to increase in engine or engine coolant temperature or in response to operation of electric heating means or the like to regulate choke operation to facilitate engine starting and engine warm up on a cold day.

In some conventional systems as shown in U.S. Pat. No. 4,083,336 for example, a heater is arranged so it is usually operated on a warm day when very little choking operation is required. On a cold day, the heater is not normally energized when engine operation is initiated but is usually energized only after a period of engine warm up has occurred when thermally responsive switch means located near the heater have been heated to a selected temperature. In that arrangement, operation of the heater on a cold day primarily serves to bring about a more rapid final opening of the choke. In some applications of systems, the choke valve may start to open more slowly than is desirable so there is an initial period of operation after engine starting when the system achieves poorer fuel economy than is necessary for achieving smooth engine start up. On the other hand, if the thermostat metal coil were modified to start to open the choke valve more quickly to improve fuel economy, the choke valve would tend to open too far before adequate engine warm up occurs and would tend to cause poor engine driveability during a part of the engine warm up period, particularly where sharp engine acceleration occurs during the warm up. In other known systems such as that shown in U.S. Pat. Nos. 3,806,854 and 4,237,077 for example, one heater is energized on initiation of engine operation on a cold day and a second heater is activated to supplement that heating after a degree of engine warm up occurs. In those systems, the choke valve also starts to open relatively slowly and then opens at a faster rate after some engine warm up has taken place. In one known fuel supply system as shown in U.S. Pat. No. 4,331,615, the system provides relatively rapid reduction in choke valve biasing force when the choke valve first starts to open and then provides relatively slower opening of the choke to maintain adequate engine driveability during the main part of the engine warm up period. However that fuel supply system is relatively more complex than is desired for many high volume applications and it would be desirable if that particular form of choke operation could be achieved in a more compact and economical way.

SUMMARY OF THE INVENTION

It is an object of this invention to provide a novel and improved fuel supply system for an automotive engine; to provide such an improved system in which a choke valve starts to open relatively rapidly after initiation of engine operation to enhance fuel economy after engine starting has occurred, and in which the choke valve thereafter continues to open at a relatively slower rate to enhance engine driveability as engine warm up takes place; to provide such an improved system in which such regulation of choke valve operation is achieved in a more compact and economical device; and to provide such an improved system which is of rugged and reliable construction.

Briefly described, the novel and improved fuel supply system of this invention comprises a carburetor having an air-fuel induction passage for providing a mixture of air and fuel to an automotive engine, an unbalance-mounted air-movable choke valve mounted for movement across the passage to regulate air flow into the passage, thermally responsive thermostat metal coil spring means operatively connected to the choke valve and movable in response to increase in temperature of the spring means for biasing the choke valve toward a position restricting air-flow into the passage with a force which decreases over a selected force range in response to increase in temperature of the thermally responsive spring means over a selected temperature range, and electrical heating means operable on initiation of engine operation for heating the thermally responsive coil spring means. In accordance with this invention, a thermally responsive control means, preferably responsive to heating by initial operation of the heating means, is operable with a selected time delay after the initiation of heater operation for deactivating or deenergizing at least a portion of the heater means. Preferably also the control means are further operable for activating, or preferably reactivating, a portion of the heater means after a further delay period in response to further heating of the control means. In a preferred embodiment of the invention, the heating means includes an additional heater portion which remains energized throughout heating of the thermally responsive spring means over said selected temperature range for providing more precisely controlled heating. In that system, a compact and economical structure is achieved and operation of the heater means provides a fast initial decrease in choke valve biasing force to enhance fuel economy after engine starting has occurred, provides a subsequent period during which the choke valve biasing force is decreased relatively more slowly to assure adequate engine driveability as engine warm up takes place, and provides a final rapid completion of choke opening to enhance fuel economy after driveability has been assured by engine warm up.

In a preferred embodiment of the invention, the control means comprises movable and complementary contact means which are preferably mounted at respective opposite sides of an insulating housing and which are connectable between a power source and portion of the heater means. Means preferably bias the movable contact means to move toward engagement with the complementary contact means and a pair of dished bimetal elements are disposed in facing relation to each other between the contacts, preferably in electrically insulated relation to the contacts. Preferably each of the dished bimetal elements has a central aperture and the elements are adapted to move with snap action to inverted dished configuration as they are heated to respective different temperatures within the above-noted temperature range. The bimetal elements are typically aligned by the walls of the insulating housing so that the contact means are engaged with each other through the apertures in the bimetal elements when operation of the automotive engine is initiated, are separated when one of the elements moves to its inverted configuration in response to selected increase in temperature, and are reengaged when the second element moves to its inverted configuration in response to further increase in temperature of the control means.

DESCRIPTION OF THE DRAWINGS

Other objects, advantages and details of construction of the novel and improved fuel supply system of this invention and control therefore are illustrated in the drawings in which.

DESCRIPTION OF PREFERRED EMBODIMENTS

Figure 1:
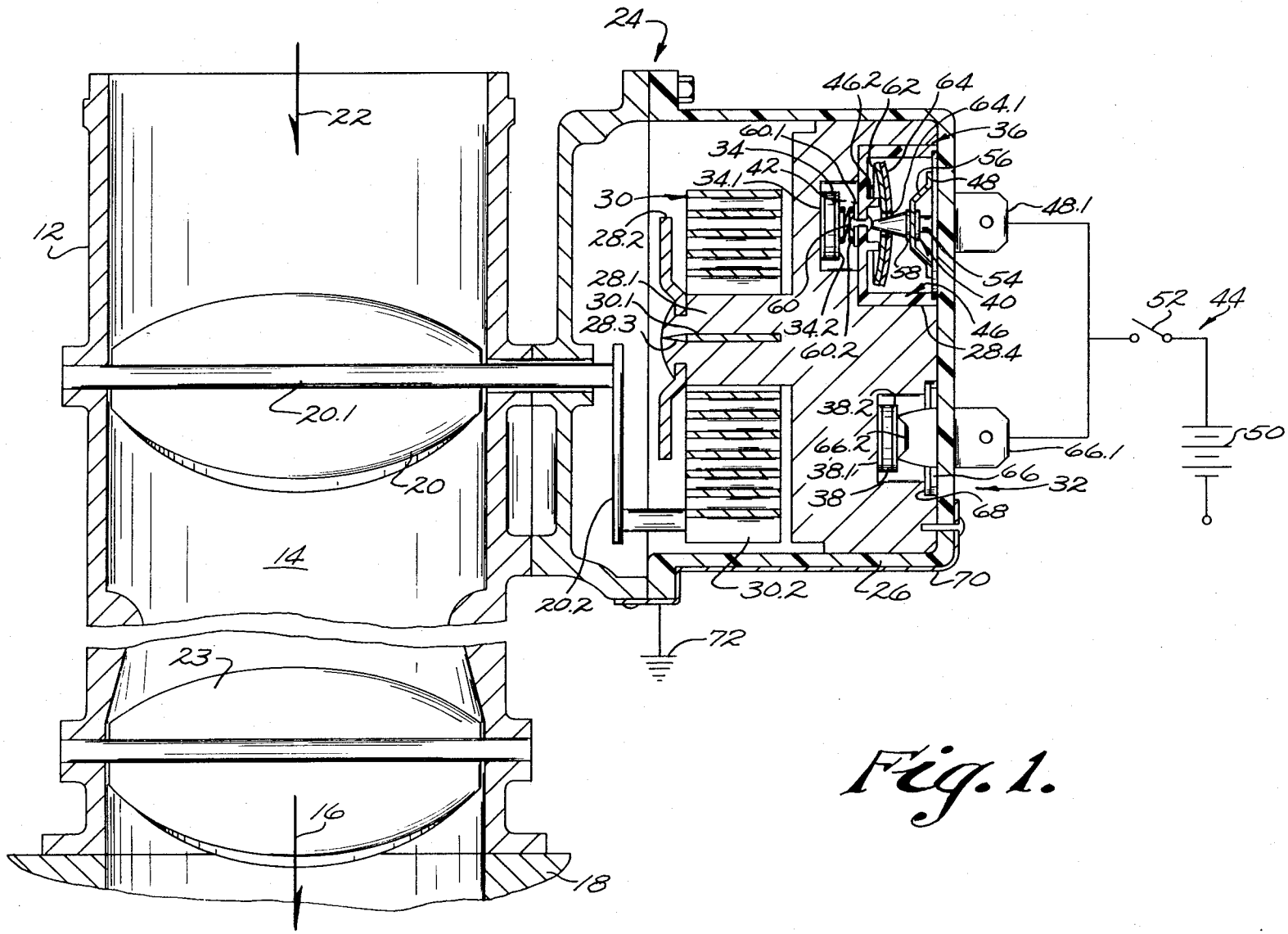
FIG. 1 is a partly diagrammatically section view along the longitudinal axis of a fuel supply system of this invention.
Figure 2:
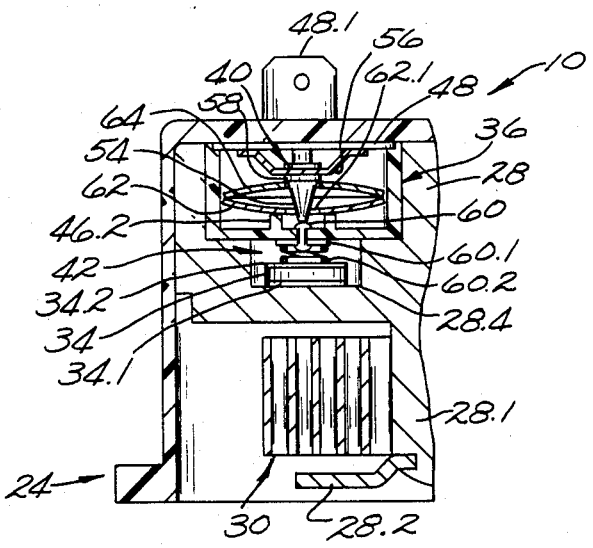
FIGS. 2 and 3 are partial section views similar to FIG. 1 illustrating alternate positions of the control means of the system of FIG. 1 in different stages of system operation.
Figure 3:
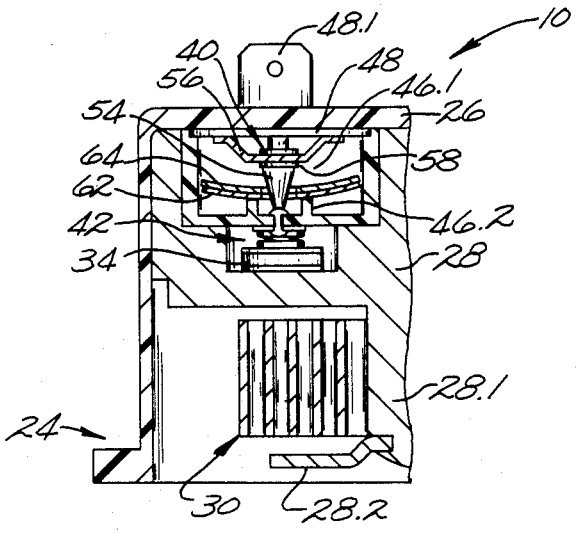

Referring to the drawings, 10 in FIGS. 1–3 indicates the novel and improved fuel supply system of this invention which is shown to include a carburetor 12 having an air-fuel induction passage 14 for providing a mixture of air and fuel (as indicated by arrow 16) to an internal combustion engine 18 of an automobile or the like as is diagrammatically shown in FIG. 1. The system also includes an unbalance-mounted air-movable choke valve 20 which is movable across the passage 14 for regulating the entry of air 22 into the passage. That is, the choke valve is unbalance-mounted on shaft 20.1 so the valve tends to move toward an open position in the passage 14 when air 22 is drawn into the passage by engine vacuum. However, a crank 20.2 is arranged at the end of the shaft for use in moving the valve to a closed position for substantially restricting the flow of air into the passage 14. The system further incorporates a thermally responsive choke control 24 which is operatively connected to the crank 20.2 for regulating operation of the choke valve. A throttle 23 is selectively operable to regulate the flow of the air-fuel mixture to the engine as will be understood. As the carburetor, engine, throttle and choke valve as thus far described are conventional, they are not further described and it will be understood that, when engine 18 is started, engine vacuum tends to draw a mixture of air and fuel through passage 14 into the engine and the flow of air 22 into the passage tends to move the choke valve toward an open position in the passage 14. The choke control 24 then regulates choke valve movement as hereinafter described to improve engine performance during engine start up while also improving fuel efficiency and reducing pollutant emission in the engine exhaust.

The thermal control 24 includes a generally cup-shaped open-end housing 26 of a phenolic resin or glass-filled nylon material or the like which is strong and rigid and electrically insulating. A heat sink 28 of aluminum or other thermally conducting metal material is mounted in the housing and is provided with a central stud 28.1 which stands out from one side of the heat sink. A thermally responsive, spiral, coil, thermostat metal spring 30 has one end 30.1 secured to the stud 28.1 in any conventional way and has a spring tang 30.2 at the opposite end of the spring which is adapted to move angularly around the outer periphery of the spring as the spring coils and uncoils in response to temperature changes. The spring 30 is shown as incorporating a single layer of metal to facilitate illustration of the spring but it will be understood that the spring is formed of a thermostatic bimetal material or the like which is adapted to uncoil and move tang 30.2 to a selected angular extent around the stud 28.1 in response to increase in spring temperature over a selected temperature range. Typically the spring is selected to move the tang 30.2 over an arc of about 80° as the spring temperature increases from 0° F. to 75° F., thereby to reduce the force biasing the choke valve to closed position about 0.8 inch-ounces per angular degree of tang movement. Preferably, a heat-sink flange 28.2 is secured to the stud 28.1 and the stud is headed over in slot 28.3 receiving the spring end 30.1 for securing the spring to the stud and for substantially enclosing the thermally-responsive spring 30 in heat sink material.

In a preferred embodiment of the invention, the thermally responsive control 24 further includes heater means 32 which are arranged in heat-transfer relation to the spring 30. Preferably for example, the heater means comprises a self-regulating electrical resistance heater unit 34 such as a ceramic heater unit of a material such as lanthanum-doped barium titanate or the like having a positive temperature coefficient of resistivity (PTC). One side 34.1 of the heater unit is connected in electrically and thermally conducting relation to the heat sink 28 and a thermally responsive control switch means 36 is arranged to regulate operation of the heater unit 34. In a preferred embodiment of the invention, a second heater unit 38 of corresponding structure is also mounted on the heat sink with one side 38.1 of the second heater unit connected in electrically and thermally conducting relation to the heat sink. As noted, each heater unit 34 and 38 is preferably self-regulating in that, when it is energized, it initially provides heat to the heat sink for heating the spring 30 and then tends to stabilize at a selected, safe, elevated temperature, typically on the order of 80° C. to 180° C. until the heater unit is subsequently deenergized.

In accordance with this invention, the thermally responsive switch means 36 includes movable contact means 40 and complementary contact means 42 which are connectable between a power source 44 and at least a portion of the heater means 32. Preferably for example, the switch means 36 comprises a cup-shaped insulating housing 46 which is open at one end and which is typically mounted in a recess 28.4 in the heat sink. A terminal 48 is mounted at one side of the housing 46 over the open housing end and a terminal end 48.1 extends through an opening (not shown) in the choke control housing 26 to be connected to a power source such as the automotive battery diagrammatically indicated at 50 in FIG. 1 through the automotive ignition switch 52. The movable contact means also preferably comprises a contact unit 54 which is electrically connected to a spider spring 56 secured to the terminal 48 to bias contact unit 54 toward the opposite side of the switch housing. The complementary contact means 42 is mounted at the opposite side of the switch housing, the complementary contact means including a rivet 60 which extends through the bottom of the switch housing 46 to secure a contact plate 60.1 on the outer side of the switch housing and a conductive spring 60.2 resiliently electrically connecting the contact plate to a second side 34.2 of the heater unit 34. An insulating cylindrical abutment 46.2, preferably integral with the switch housing, surrounds the complementary contact rivet 60 inside the switch housing.

In accordance with this invention, the thermally responsive switch means 36 further includes a pair of dished thermally responsive bimetallic elements 62 and 64 each of which generally corresponds in shape to a segment of a sphere and each of which preferably has a central aperture 62.1 and 64.1. The dished bimetallic elements are each adapted to move with snap action from an original dished configuration as shown in FIG. 1 to an inverted dished configuration as shown in FIGS. 2 and 3 in response to heating of the elements to selected different actuation temperatures in conventional manner. The bimetallic elements are then adapted to return to their original configuration when subsequently cooled. Preferably for example, where the coil spring 30 is to be heated over a selected temperature range from 0° F. to 75° F. as suggested above, the bimetallic elements 62 and 64 are preferably adapted to move with snap action to their inverted dished configurations at temperatures of 40° F. to 50° F. and about 70° F. respectively.

In accordance with this invention, the dished bimetallic elements 62 and 64 are disposed in facing relation to each other between the movable and complementary contact means 40 and 42. Preferably, they are disposed in the nested relationship illustrated in FIG. 1 so that the elements rest on the abutment 46.2, so that the element apertures fit around the contact unit 54, and so that the insulating washer 58 is disposed relative to the element 64 as shown in the drawings to keep the bimetallic elements electrically insulated from the contact means 40 and 42 while normally permitting the contact means 40 and 42 to be electrically engaged through the element apertures as shown in FIG. 1. Preferably, the housing 46 is proportioned so that the housing walls keep the bimetal elements aligned with each other between the contacts as shown.

In a preferred embodiment of the invention, the choke control 24 further includes a second terminal 66 which is electrically insulated from the heat sink 28 by an insulating spacer 68, which has a terminal end 66.1 extending through the choke housing 26 through an opening (not shown), and which has a spring terminal end 66.2 resiliently engaging a second side 38.2 of the second heater unit 38. The terminal end 66.1 is preferably connected to the power source 50 via the ignition switch 52 as shown in FIG. 1 and a ground strap 70 is connected to the heat sink 28 to connect the heat sink to electrical ground via the carburetor and engine as is diagrammatically illustrated at 72 in FIG. 1. In that way, the heater units 34 and 38 are adapted to be connected in parallel relation to each other. That is, the heater unit 34 is activated or energized from the power source 50 via terminal 48, the movable contact means 40, complementary contact means 42, the heater unit side 34.2, the heater unit 34, heater side 34.1, the heat sink 28 and the ground strap 70 to electrical ground 72. The heater unit 38 is energized from the same power source via the terminal 66 to the heater and via the heat sink 28 to ground.

In operation of the system of this invention as thus described on a cold day, the choke valve 20 is normally in a closed position in the air-fuel passage 14 when operation of the engine 18 is started and the thermally responsive spring 30 normally biases the choke valve to the closed position in the passage with substantial force. However, the movable and complementary contact means 40 and 42 are normally engaged through the apertures in the bimetallic elements 62 and 64 when operation of the engine is initiated by closing of the ignition switch 52 so that both portions 34 and 38 of the heater means are energized as engine operation is started. In that way, the heater means rapidly generate heat and transfer that heat to the coil spring 30 via the heat-sink 28 so that the choke valve 20 starts to move toward an open position to reduce the choke valve biasing force within a short time after engine starting and moves relatively rapidly toward that position while both of the heater units 34 and 38 are energized. In that way, the choke control provides improved fuel economy in the period of engine operation immediately after the engine is started on a cold day. However, as that heat is generated, the dished bimetallic element 62 is heated to its actuating temperature, primarily by operation of the heater unit 34 itself, and, with a time delay after initiation of operation of the heating means, moves with snap action to its inverted configuration as shown in FIG. 2. In that disposition, the bimetal element 62 holds the contact means 40 and 42 separated against the bias of the spider spring 56 and deenergizes the portion of the heater means 32 constituted by the heater 34. As that occurs, the rate of heating of the spring 30 slows and choke valve 20 opens and reduces choke valve biasing force more slowly for a period of time. In that way, the system 10 assures that the engine driveability is properly maintained during the principal part of the period during which engine warm up occurs and provides improved engine performance, particularly if the engine should be sharply accelerated by opening of the throttle 23 during that warm up period.

Then, as further heating of the thermally responsive switch means by the heater means 32 takes place (this heating being primarily by the heater means 38) the second bimetal element 64 is heated to its actuating temperature and, with a further delay after first operation of the heater means 32, moves with snap action to its inverted dished configuration as shown in FIG. 3, thereby to reengage the contact means 40 and 42 and to reenergize the heater 34. In that arrangement, the heater means 34 again supplements heating of the coil spring 30 by the heater 38 for rapidly completing the opening of the choke valve 20 and completing the desired reduction in the choke valve biasing force over said selected force range to enhance fuel economy after engine driveability has been assured by the engine warm up. When subsequent interruption of engine operation results in cooling of the engine and of the thermal control 24, the bimetal elements 62 and 64 are adapted to return to their original dished configuration with snap action as they are cooled as will be understood.

In that system, improved engine operation is achieved particularly for certain high performance engines or the like in a novel and advantageous manner. The system is novel, compact and economical and is of rugged and reliable construction. It should be understood that although the invention has been described by reference to a preferred embodiment of the invention by way of illustrating the invention, the invention includes various modifications and equivalents of the disclosed embodiments falling within the scope of the appended claims. It will be also noted that the thermally responsive switch means provided by this invention are also adapted for use in regulating other control devices than electric chokes as will be understood.

I claim:

1. A fuel supply system for an automotive engine comprising a carburetor having an air-fuel induction passage for providing a mixture of air and fuel to the engine, an unbalanced-mounted air-movable choke valve mounted for movement across the passage to regulate air-flow into the passage, thermally responsive spring means operatively connected to the choke valve and movable in response to increase in temperature of the thermally responsive spring means for biasing the choke valve toward a position restricting air-flow into the passage with a force which decreases over a selected force range in response to increase in the temperature of the thermally responsive spring means over a selected temperature range, electrical heating means operable on initiation of engine operation for heating the thermally responsive spring means, and electrical control means for regulating operation of the heater means, characterized in that, the control means comprise movable and complementary contact means connectable between a power source and the heater means for activating at least a portion of the heater means when the contact means are engaged and for deactivating said portion of the heater means when the contact means are separated, and bimetallic means arranged to dispose the contact means in said engaged position when operation of the engine is initiated to provide a fast initial decrease in choke valve biasing force to enhance fuel use by the engine, to respond to heating thereof to move the contact means to said separated position with a delay after initiation of operation of the heater means for providing a subsequent period of relatively slower decrease in choke valve biasing force as the thermally responsive spring means is heated over a first part of said selected temperature range to provide improved engine driveability during engine warm up, and to be further operable in response to further heating thereof for returning the contact means to said engaged position to reactivate said portion of the heater means to provide a relatively faster decrease in choke valve biasing force over a final part of said selected force range for enhancing fuel use by the engine after suitable engine driveability has been assured by the engine warm up.

2. A fuel supply system as set forth in claim 1 wherein additional heating means are operable on initiation of operation of the engine and remain in operation throughout heating of the thermally responsive spring means for cooperating with said first named heating means in heating the thermally responsive spring means over said selected temperature range.

3. A fuel supply system as set forth in claim 2 wherein the bimetallic means comprises a pair of dished bimetallic elements which are movable with snap action from original dished configurations to inverted dished configurations in response to respective selected increases in temperature within said selected temperature range, the dished bimetallic elements being arranged to dispose the contact means in said separated position at least when the pair of bimetallic elements has one combination of said dished configurations and to dispose the contact means in said engaged position at least when the pair of bimetallic elements has a second combination of said dished configurations.

4. A fuel supply system as set forth in claim 2 wherein the bimetallic means comprises a pair of dished bimetallic elements movable with snap action from original dished configurations to inverted dished configurations in response to respective selected increases in temperature within said selected temperature range, the dished bimetallic elements being arranged to dispose the contact means in said engaged position when the bimetallic elements are both in their original dished configuration, to dispose the contact means in said separated position when one of the bimetallic elements moves to its inverted dished configuration in response to selected increase in temperature, and to restore the contact means to said engaged position when the other bimetallic element moves to its inverted dished configuration in response to further increase in temperature.

5. A fuel supply system as set forth in claim 4 wherein said dished bimetallic elements are disposed in facing relation to each other between the contact means and are nested with each other between the contact means when the elements are both in their original dished configuration or both in their inverted dished configuration, and at least one of the elements has an aperture therein permitting the contact means to be engaged through said aperture when the bimetallic elements are in said nested relation, the bimetallic elements being operable to move the contact means to said separated contact position at least when one of the elements moves out of said nested relation to a selected dished configuration in response to a selected increase in temperature.

6. A fuel supply system as set forth in claim 5 wherein the control means comprises insulating housing means, the complementary contact means are mounted at one side of the insulating housing means, the movable contact means are mounted at the opposite side of the insulated housing means and are resiliently biased toward the complementary contact means, the dished elements being disposed in facing relating to each other and having respective apertures therein aligned between the contact means for permitting the contact means to be resiliently engaged through said apertures when the elements are in nested relation to each other and to be held in said separated position when said one bimetallic element is in its inverted dished configuration.

* * * * *